United States Patent [19]

Long

[11] 3,934,933

[45] Jan. 27, 1976

[54] THERAPEUTIC SEAT PAD FOR AUTOMOBILES

[76] Inventor: Anthony J. Long, P.O. Box 697, Warsaw, Mo. 65355

[22] Filed: June 26, 1974

[21] Appl. No.: 483,302

[52] U.S. Cl. ..... 297/384; 5/338; 297/219

[51] Int. Cl.[2] ..... A47C 3/00

[58] Field of Search ..... 297/284, 312, 219, 223, 297/226, 453, 458; 5/341, 338, 357, 352, 345 R, 91

[56] References Cited

UNITED STATES PATENTS

| | | | |
|---|---|---|---|
| 1,045,228 | 11/1912 | Weltmer | 5/91 |
| 1,635,588 | 7/1927 | Taplin | 5/91 X |
| 1,853,579 | 4/1932 | Sallop | 297/223 |
| 2,120,036 | 6/1938 | Northup | 297/226 X |
| 2,462,579 | 2/1949 | Warner | 5/91 X |
| 2,765,480 | 10/1956 | Mueller | 5/341 X |
| 3,220,767 | 11/1965 | Hendrickson | 297/219 |
| 3,296,635 | 1/1967 | O'Hanlan | 297/219 X |
| 3,371,957 | 3/1968 | Cook | 297/219 |
| 3,451,071 | 6/1969 | Whiteley | 5/91 |
| 3,626,526 | 6/1969 | Viel | 5/345 R |
| 3,636,576 | 1/1972 | Nissen | 5/352 |
| 3,707,008 | 12/1972 | Fellin et al. | 5/341 |
| 3,742,526 | 7/1973 | Lillard | 5/357 |
| 3,742,528 | 7/1973 | Münch | 5/345 R |
| 3,749,442 | 7/1973 | Berg | 297/312 |

FOREIGN PATENTS OR APPLICATIONS

| | | | |
|---|---|---|---|
| 598,426 | 2/1948 | United Kingdom | 5/91 |
| 1,277,291 | 6/1972 | United Kingdom | 297/312 |
| 48,176 | 4/1888 | Germany | 297/312 |

*Primary Examiner*—James T. McCall
*Attorney, Agent, or Firm*—John A. Hamilton

[57] ABSTRACT

A therapeutic seat pad for automobiles adapted to level the seat transversely and also to provide a firmer seating surface, both with the purpose of alleviating the discomfort and even pain resulting from long periods of immobility while driving. The seat pad consists of a substantially firm but flexible base pad adapted to overlie and be attached to the automobile seat, and levelling pads adapted to applied over and attached to the base pad in two stacks, with one stack beneath the left side of the pelvis of the user and the other beneath the right side. Pads may be added to each stack in whatever number may be required to level the user's pelvis laterally.

7 Claims, 4 Drawing Figures

THERAPEUTIC SEAT PAD FOR AUTOMOBILES

Figure 1:
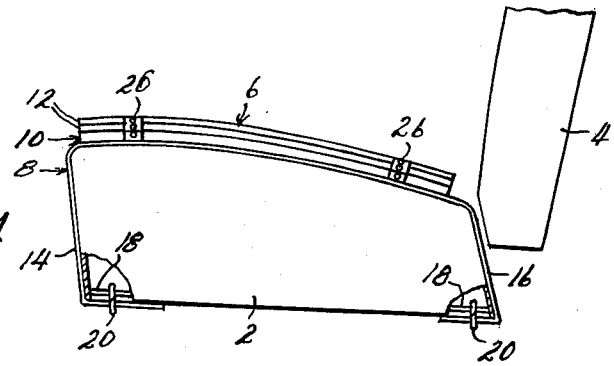

This invention relates to new and useful improvements in automobile seating apparatus, and has particular reference to a device which will relieve much of the acute discomfort and even intense pain commonly suffered by motorists on long drives.

A common cause of such discomfort and pain is that the person's pelvis becomes tilted to one side or the other, the resulting strain on certain back muscles causing first a fatigue, which gradually increases and eventually may cause an extremely tense or spastic condition of these muscles, which is very painful. The lateral tilting of the pelvis may result from several causes. In many persons, the pelvis itself is tilted as a result of some injury, spinal defect or deterioration, or because the legs are of different lengths, which may eventually result in a permanent spinal curvature and tilting of the pelvis. Such persons cannot sit for long periods of time on surfaces which actually are laterally level, without suffering pain and discomfort, but require a seating surface of which is laterally tilted to a positive degree. However, even "normal" persons may suffer much the same discomfort and pain symptoms when immobilized for long time periods in automobile seats. This may result from the fact that many if not most automobile seats are not actually laterally level, but tilted in greater or lesser degree, causing the user's pelvis to tilt and resulting in fatigue and eventual possible spasm of certain muscles, particularly in the lower back. Or the seat itself may be so soft and deeply yieldable, as dictated by present day standards of comfort and style, which are often erroneous from the standpoint of comfort in long periods of driving, that the motorist's pelvis is not firmly supported, and he sits with his pelvis tilted without perhaps even realizing it. Nevertheless, even a slight tilting which may initially be imperceptible can cause eventual fatigue and pain. For such normal persons, the prime requirement is that the seating surface be laterally level, and perhaps firmer than is usually the case in most automobiles, but in some cases some reduction of fatique, or "rest," can be obtained by intentionally tilting the seating surface periodically in alternately opposite directions.

Accordingly, the principal object of the present invention is the provision of a therapeutic seat pad for automobiles including two spaced apart pads adapted to be disposed respectively beneath the left and right sides of the user's pelvis, and including means for adjusting the thickness of the two pads independently of each other, whereby either to level the user's pelvis laterally, or to tilt it intentionally, whichever may be required for a particular user.

Another object is the provision of a seat pad of the general character described which also serves to firm or stiffen the basic seat cushions of the automobile.

Still another object is the provision of a seat pad of the general character described which can be readily applied to the seats of virtually any automobile, and in which the adjustment of the pad thicknesses can be made easily and conveniently.

Figure 2:
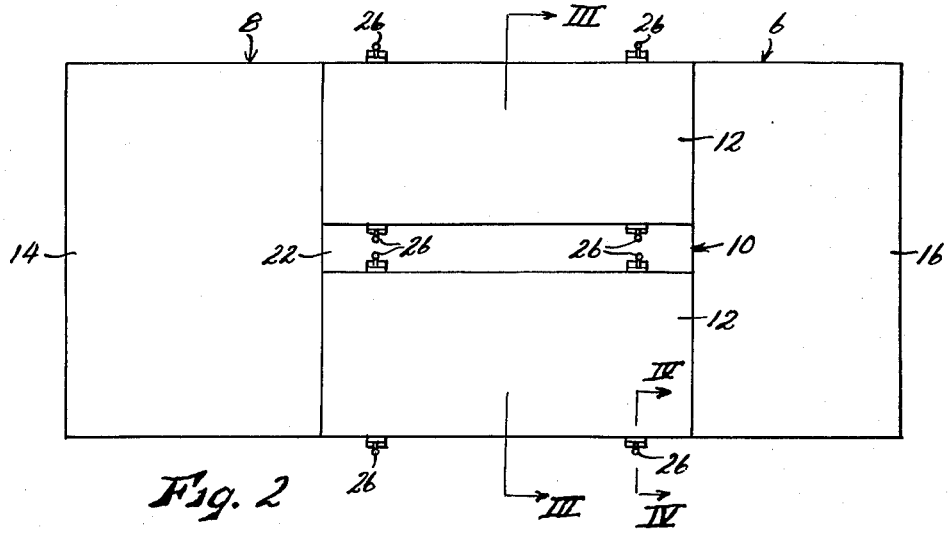
Figure 3:
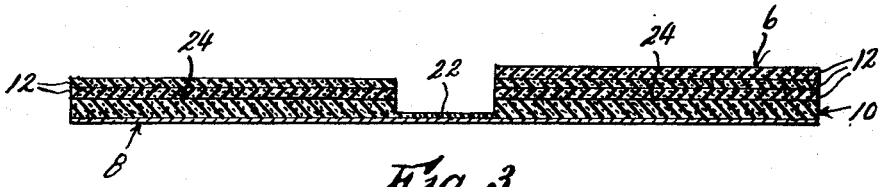
Figure 4:
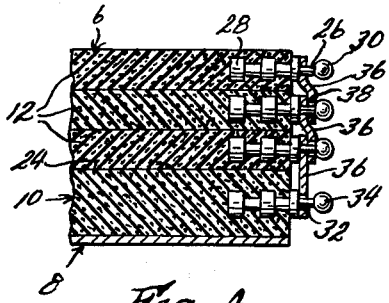

With these objects in view, as well as other objects which will appear in the course of the specification, reference will be had to the accompanying drawing, wherein:

FIG. 1 is a side elevational view of a therapeutic seat pad for automobiles embodying the present invention, shown operatively applied to an automobile seat structure, said seat structure being shown fragmentarily and with portions broken away, FIG. 2 is a top plan view of the seat pad laid out flat, FIG. 3 is an enlarged sectional view taken on line III—III of FIG. 2, and FIG. 4 is an enlarged, fragmentary sectional view taken on line IV—IV of FIG. 2.

Like reference numerals apply to similar parts throughout the several views, and the numeral 2 applies, in FIG. 1, to the seat cushion of an automobile seat, the back cushion being indicated at 4. The therapeutic seat pad forming the subject matter of the present invention is indicated generally by the numeral 6, and includes a mounting sheet 8, a base pad 10, and a number of levelling pads 12. Mounting sheet 6 is formed of a strong but pliable fabric, and is generally rectangular, being adapted to be laid over the top surface of seat cushion 2 with its major axis extending from front to rear of said seat. Its forward and rearward portions form aprons 14 and 16 which are adapted to be secured to the seat cushion structure in any suitable manner. As shown, said aprons are lead downwardly around the respective forward and rearward edges of the seat assembly, turned under the bottom of said assembly, and secured to the substructure 18 of said assembly as by clips 20. Base pad 10 comprises a thick sheet of foam rubber or the like, bonded or otherwise affixed to mounting sheet 8 so as to overlie the top surface of seat cushion 2, when said mounting sheet is applied thereto as described. Said base pad is divided by a groove 22 extending from front to rear along the longitudinal midline thereof, leaving relatively elevated surfaces 24 at either side of said groove. Said elevated surfaces are spaced apart, groove 22 preferably being no more than two inches wide, so that when a person sits in a position laterally centered relative to the pad, the lower left point of his pelvis will rest over one of said surfaces, and the lower right point of his pelvis will rest on the other.

Each levelling pad 12 corresponds in area and configuration to one of surfaces 24 of the base pad, and is formed also of foam rubber or the like. Any desired number of levelling pads 12 may be applied in stacked relation to each of surfaces 24 of the base pad. Each levelling pad has a plurality (two shown) of horizontally outwardly extending pins 26 secured in each longitudinal edge thereof, each of said pins being provided with an extension 28 firmly molded or bonded in the material of the pad, and being provided at its outwardly extended end with a rounded enlargement knob 30, all as shown in FIG. 4. Similarly, base pad 10 is provided with a pin 32 having a knob 34 in a number of positions corresponding to and aligned with the pins 26 of the levelling pads. Said base pad pins are mounted in the longitudinal side edges of the base pad, and in the side walls of groove 22 of said base pad. Permanently affixed to each pin 26 of each levelling pad is a flexible flap 36, preferably formed of an elastic, plastic or the like. Said flap depends from the pin to which it is affixed and has a hole 38 formed in the depending portion thereof which is adapted to be snapped releasably over the knob 30 of the associated pin 26 of the next lower levelling pad in the stack. The flaps 36 of the lowermost levelling pad in the stack are adapted to be engaged over the pins 32 of the base pad, all as shown in FIG. 4.

The operation of the seat pad as just described is obvious. Levelling pads 12 are applied to each surface 24 of the base pad in whatever number may be required, equal or unequal, to tilt the pelvis of a person sitting on the device as may be desired, whether actually horizontal or not. That is, said levelling pads may be used to level a seat cushion 2 which normally is not level in a transverse direction, or to provide a deliberate lateral tilting of the seating surface which may be required by persons having a pelvis which is normally tilted due to spinal curvature or the like, or to tilt the seating surface deliberately first in one direction and then the other, at periodic intervals, simply to provide "rest" or relaxation of tension and fatigue, for normal persons who must occupy the seat for long periods of time.

The cushion material of which the base and levelling pads are formed is preferably quite hard or firm, as compared to the extremely soft foam with which most automobile seats are commonly upholstered in order to reduce the poor posture and resulting fatigue often caused by cushions which are "too soft." That is, the soft cushion material of seat 2 still underlies the present device, and of course still yields, but the firmness of the present device distributes the weight of the user over a greater area of the seat, and does not itself conform to or "cup" the user's posterior to the same degree as would seat 2, and the general effect to the user is that the seat is harder. This encourages better posture and hence reduces fatigue. The center groove 22 of the base pad, and the spaced apart relation of the levelling pads permits free circulation beneath the user, and thereby promotes greater comfort. The "foamed" nature of the pads also provides better air circulation.

While I have shown and described a specific embodiment of my invention, it will be readily apparent that many minor changes of structure and operation could be made without departing from the spirit of the invention. For example, while the pad has been described for use in automobile seating, it is obviously adapted for use in any other type of seating as well.

What I claim as new and desire to protect by Letters Patent is:

1. A thereapeutic seat pad comprising:

a. a generally planar base pad adapted to overlie the top surface of a seat cushion and having laterally spaced apart portions adapted respectively to support the left and right sides of the pelvis of a person sitting thereon, b. attaching means operable to secure said base pad to said seat cushion, and c. adjusting means operable to vary the thickness of the laterally spaced sections of said base pad independently of each other.

2. A seat pad as recited in claim 1 wherein said attaching means comprises a sheet of pliable material affixed to said base pad and extending outwardly from said base pad to form pliable aprons, said aprons being adapted to be affixed to said seat cushion.

3. A seat pad as recited in claim 1 wherein said adjusting means comprises:

a. a plurality of levelling pads each adapted to overlie one of the laterally offset portions of said base pad, and b. securing means operable to secure any selected number of said levelling pads in stacked relation to each of said base pad portions.

4. A seat pad as recited in claim 3 wherein said securing means comprises:

a. outwardly extending pins secured in the edges of each of said levelling pads, and in the edges of each of the laterally offset portions of said base pad, and b. a flexible flap secured permanently to each of said pins of each of said levelling pads, and depending therefrom, each of said flaps being releasably engageable on the corresponding pin of the next lower levelling pad in the stack, and the flaps of the lowermost levelling pad in the stack being releasably engageable on the corresponding pins of said base pad.

5. A seat pad as recited in claim 3 wherein said laterally spaced portions of said base pad are divided and spaced apart by a groove of substantial depth formed in the top surface of said base pad, said levelling pads not overlying said groove, whereby to provide for the circulation of air beneath the user.

6. A seat pad as recited in claim 5 wherein said base pad and said levelling pads are formed of porous material, whereby further to improve the circulation of air beneath the user.

7. A seat pad as recited in claim 3 wherein said base pad and said levelling pads are formed of a flexible material which is relatively hard and firm as compared to the cushioning material utilized in said seat cushion.

* * * * *